US008770469B2

(12) United States Patent
Burke et al.

(10) Patent No.: US 8,770,469 B2
(45) Date of Patent: Jul. 8, 2014

(54) CARTON WITH TOP GUSSET

(75) Inventors: Bradley J. Burke, Glendale Heights, IL (US); Scott T. Strand, Lake Elmo, MN (US)

(73) Assignee: Graphic Packaging International, Inc., Atlanta, GA (US)

( * ) Notice: Subject to any disclaimer, the term of this patent is extended or adjusted under 35 U.S.C. 154(b) by 746 days.

(21) Appl. No.: 12/622,911

(22) Filed: Nov. 20, 2009

(65) Prior Publication Data

US 2010/0127061 A1 May 27, 2010

Related U.S. Application Data

(60) Provisional application No. 61/199,965, filed on Nov. 21, 2008.

(51) Int. Cl.

| | |
|---|---|
| ***B65D 5/00*** | (2006.01) |
| ***B65D 5/54*** | (2006.01) |
| ***B65D 5/42*** | (2006.01) |
| ***B65D 65/28*** | (2006.01) |
| ***B32B 3/10*** | (2006.01) |

(52) U.S. Cl.
USPC ..... 229/165; 229/138; 428/542.8; 493/128

(58) Field of Classification Search
CPC ..... B29C 66/1122; B65D 5/067; B65D 2571/0066; B65D 5/061; B65D 5/069; B65D 5/244
USPC ..... 229/138, 137, 242, 139, 125.42
See application file for complete search history.

(56) References Cited

U.S. PATENT DOCUMENTS

| | | | | | |
|---|---|---|---|---|---|
| 83,812 | A | * | 11/1868 | Wilcox | 229/138 |
| 362,583 | A | * | 5/1887 | Jordan | 229/138 |
| 567,649 | A | * | 9/1896 | Lanzit | 229/117.14 |
| 1,082,868 | A | * | 12/1913 | Hollett | 229/125.39 |
| 2,757,851 | A | * | 8/1956 | Moore | 229/122.23 |
| 3,300,115 | A | * | 1/1967 | Schauer | 221/305 |
| 4,252,267 | A | * | 2/1981 | Osborne | 229/145 |
| 4,313,553 | A | | 2/1982 | Lisiecki | |
| 4,762,234 | A | | 8/1988 | Wyberg | |

(Continued)

FOREIGN PATENT DOCUMENTS

| | | | |
|---|---|---|---|
| KR | 20-1998-0019535 | U | 7/1998 |
| KR | 10-0211329 | B1 | 8/1999 |

(Continued)

OTHER PUBLICATIONS

International Search Report mailed Jul. 6, 2010 for application—PCT/US2009/065313—Graphic Packaging International, Inc.

(Continued)

*Primary Examiner* — Gary Elkins
*Assistant Examiner* — Christopher Demeree
(74) *Attorney, Agent, or Firm* — Womble Carlyle Sandridge & Rice, LLP

(57) ABSTRACT

A carton for holding a plurality of articles. The carton comprises a gable top comprising two top panels at a top of the carton. The gable top comprises at least one gusset foldably connected to a side flap and one of the top panels. The first and second top flaps angle inwardly from a respective front panel and back panel of the carton.

49 Claims, 18 Drawing Sheets

(56) References Cited

U.S. PATENT DOCUMENTS

| | | | | |
|---|---|---|---|---|
| 5,255,494 | A | 10/1993 | Doyle | |
| 5,501,394 | A | 3/1996 | Eno | |
| 5,816,487 | A | 10/1998 | Skinner | |
| 5,988,494 | A | 11/1999 | Fontaine | |
| 5,996,882 | A | 12/1999 | Randall | |
| 6,164,821 | A | 12/2000 | Randall | |
| 6,929,172 | B2 | 8/2005 | Bates et al. | |
| 7,331,509 | B2 | 2/2008 | Bates et al. | |
| 7,617,969 | B2 | 11/2009 | Oliveira | |
| 2004/0102748 | A1 | 5/2004 | Hirotsu | |
| 2004/0112948 | A1* | 6/2004 | Bone | 229/122 |
| 2005/0209576 | A1 | 9/2005 | Hirotsu | |
| 2007/0194093 | A1* | 8/2007 | Ford | 229/144 |

FOREIGN PATENT DOCUMENTS

| | | | |
|---|---|---|---|
| KR | 10-0354924 | B1 | 10/2002 |
| KR | 10-2004-0004669 | A | 1/2004 |
| KR | 10-2005-0013599 | A | 2/2005 |

OTHER PUBLICATIONS

Written Opinion mailed Jul. 6, 2010 for application—PCT/US2009/065313—Graphic Packaging International Inc.

* cited by examiner

CARTON WITH TOP GUSSET

CROSS-REFERENCE TO RELATED APPLICATIONS

This application claims the benefit of Provisional Patent Application No. 61/199,965, filed Nov. 21, 2008, the entire contents of which are hereby incorporated by reference.

INCORPORATION BY REFERENCE

Provisional Patent Application No. 61/199,965, filed Nov. 21, 2008, is hereby incorporated by reference in its entirety for all purposes.

BACKGROUND OF THE DISCLOSURE

The present disclosure relates to packages or cartons for holding and carrying articles.

SUMMARY OF THE DISCLOSURE

In general, one aspect of the disclosure is generally directed to a carton for holding a plurality of articles. The carton comprises a gable top comprising two top panels at a top of the carton foldably connected to a respective front and back panel of the carton.

In another aspect, the disclosure is generally directed to a carton for containing a plurality of articles. The carton comprises panels that extend at least partially around the interior of the carton. The panels comprise a front panel, a first top panel foldably connected to the front panel, a bottom panel foldably connected to the front panel, a back panel foldably connected to the bottom panel, side flaps foldably connected to at least one of the panels. The carton comprises at least one gusset foldably connected to one of the first and the second top panel. The first and the second top panels form a gable top of the carton.

In another aspect, the disclosure is generally directed to a carton for containing a plurality of articles. The carton comprises a plurality of panels that extend at least partially around the interior of the carton. The panels comprise a front panel, a first top panel foldably connected to the front panel, a bottom panel foldably connected to the front panel, a back panel foldably connected to the bottom panel, and a second top panel foldably connected to the back panel. One of the front and back panels at least partially forms a lid and the other of the front and back panels at least partially forms a tray. At least one side flap is foldably connected to at least one of the front and back panels. At least one gusset is foldably connected to the at least one side flap and one of the first and the second top panels. The first and second top panels angle inwardly from a respective front panel and back panel and are at least partially in face-to-face contact to form a top of the carton.

In another aspect, the disclosure is generally directed to a blank for forming a carton for holding a plurality of articles. The blank comprises a plurality of panels that comprise a front panel, a first top panel foldably connected to the front panel, a bottom panel foldably connected to the front panel, a back panel foldably connected to the bottom panel, and a second top panel foldably connected to the back panel. One of the front and back panels is for forming a lid in the carton formed from the blank and the other of the front and back panels is for forming a tray in the carton formed from the blank. At least one side flap is foldably connected to at least one of the front and back panels. At least one gusset is foldably connected to the at least one side flap and one of the first and the second top panels. The first and second top panels are for being positioned to angle inwardly from a respective front panel and back panel and are for being positioned to be at least partially in face-to-face contact to form a top of the carton formed from the blank.

In another aspect, the disclosure is generally directed to a method of forming a carton for containing a plurality of articles. The method comprises obtaining a carton blank. The carton blank comprises a plurality of panels comprising a front panel, a first top panel foldably connected to the front panel, a bottom panel foldably connected to the front panel, a back panel foldably connected to the bottom panel, and a second top panel foldably connected to the back panel. At least one front side flap is foldably connected to the front panel. At least one back side flap is foldably connected to the back panel. At least one gusset is foldably connected to one of the first and the second top panels. The method further comprises forming a tray by folding the bottom panel, the second top panel and the at least one back side flap relative to the back panel, forming a lid by folding the first top panel and the at least one front side flap relative to the front panel, and closing the carton by folding the lid and positioning the first and second top panels to angle inwardly from a respective front panel and back panel so that the first and second top panels are at least partially in face-to-face contact to the top of the carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

DETAILED DESCRIPTION OF THE EXEMPLARY EMBODIMENTS

Cartons or packages according to the present disclosure can accommodate articles of numerous different shapes. For the purpose of illustration and not for the purpose of limiting the scope of the disclosure, the following detailed description describes articles such as food products at least partially disposed within the carton embodiments. In this specification, the terms "lower," "bottom," "upper", "top", "front", and "back" indicate orientations determined in relation to fully erected cartons.

Figure 1:
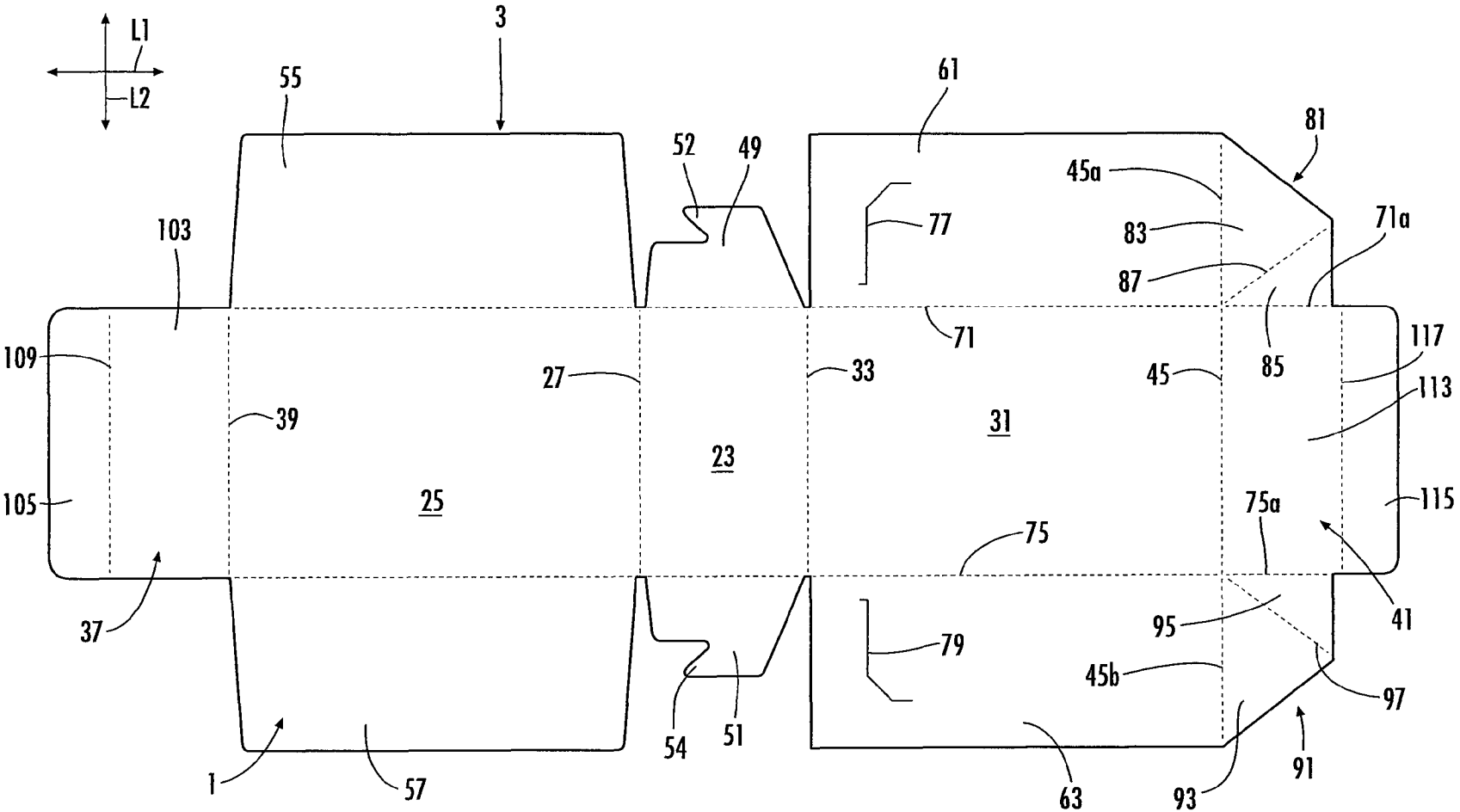
FIG. 1 is a plan view of an exterior surface of a blank for forming a carton of a first embodiment of the disclosure.
Figure 2:
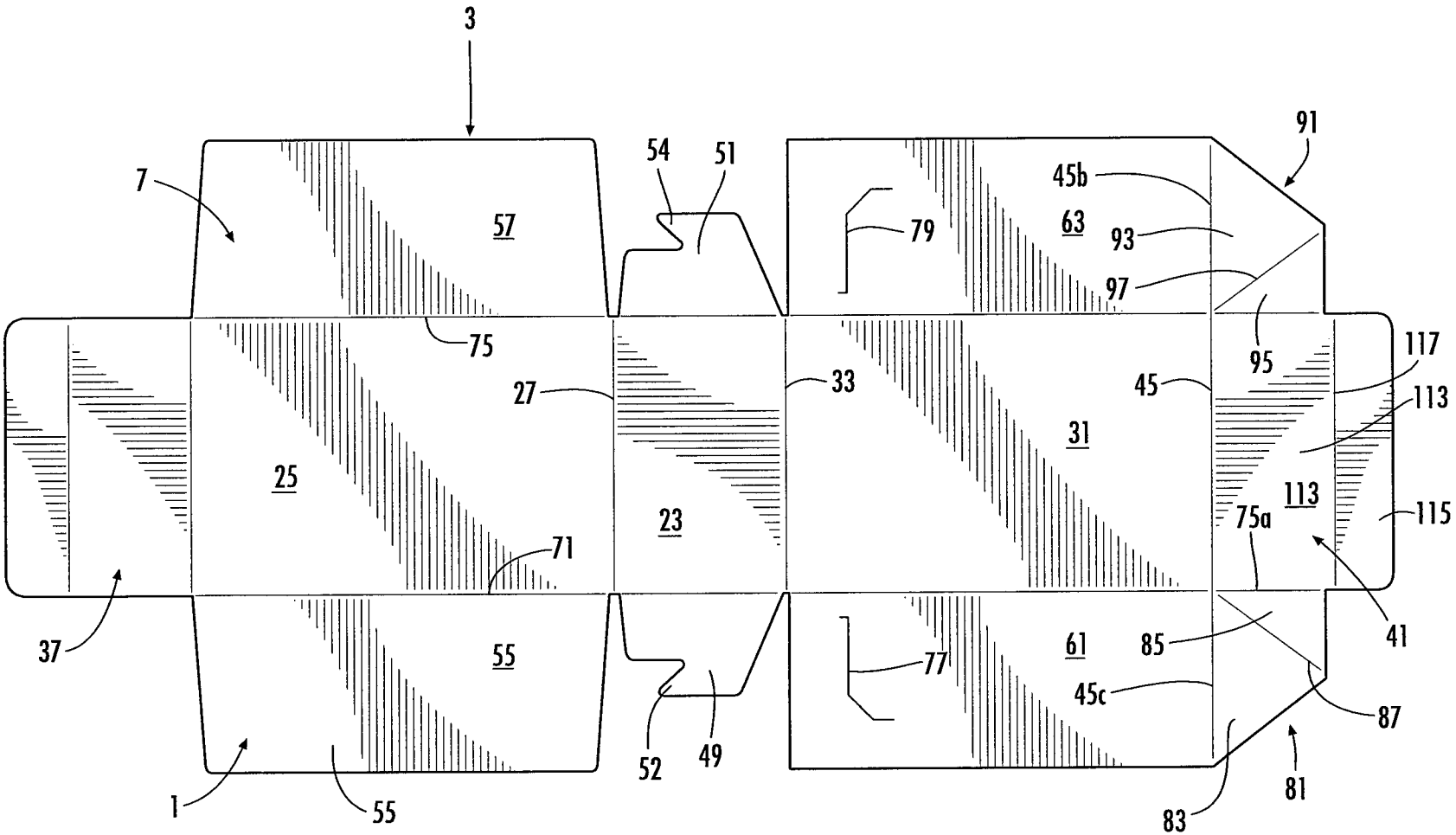
FIG. 2 is a plan view of an interior surface of the blank of FIG. 1.
Figure 9:
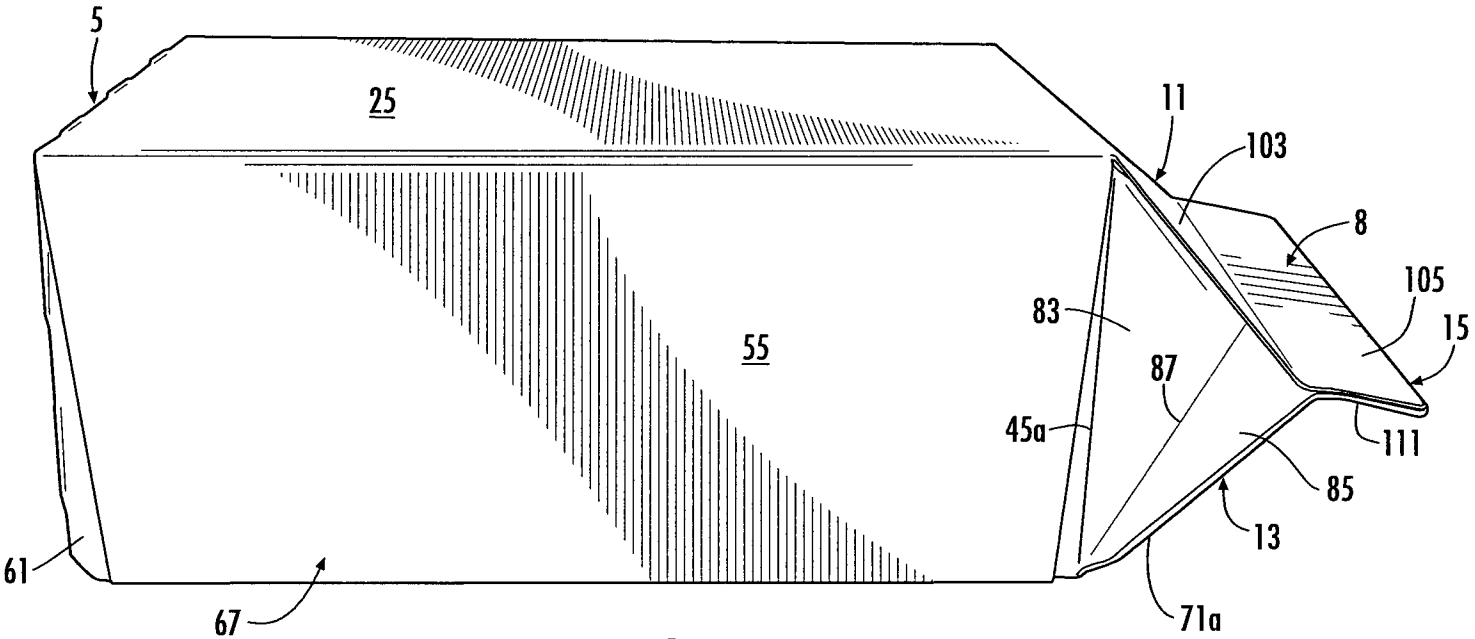
FIG. 9 is a side perspective of the carton of the first embodiment.
Figure 10:
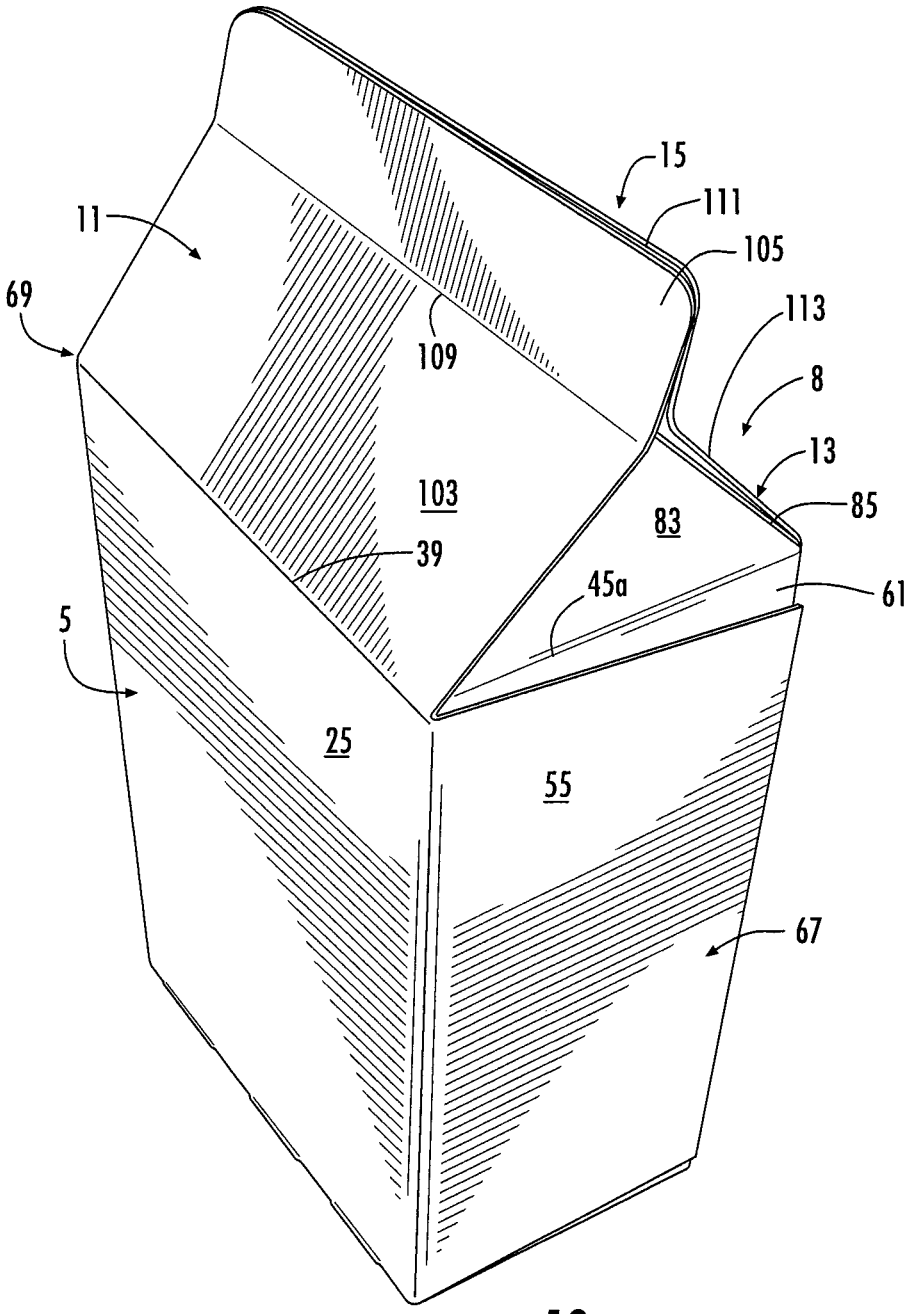
FIG. 10 is a top perspective of the carton of the first embodiment.

FIG. 1 is a plan view of an exterior surface 1 of a carton blank 3 used to form a carton 5 (FIGS. 9 and 10) of one embodiment of the disclosure. FIG. 2 shows an interior surface 7 of the blank 3. The carton 5 can be used to hold articles (not shown) such as a plurality of food products (e.g., energy bar, granola bar, dairy bar, or any other food product), beverage products, or any other article or product. As shown in FIGS. 9 and 10, the carton 5 has a gable top 8 with two upwardly sloping top walls 11, 13 that converge at a top marginal area 15 of the carton. The carton 5 can include various dispensing features and various handle features without departing from the disclosure.

The blank 3 has a longitudinal axis L1 and a lateral axis L2. The blank 3 includes a bottom panel 23 foldably connected to a front panel 25 at a lateral fold line 27. A back panel 31 is foldably connected to the bottom panel 23 at a lateral fold line 33. A first top panel 37 is foldably connected to the front panel 25 at a lateral fold line 39. A second top panel 41 is foldably connected to the back panel 31 at a lateral fold line 45.

In the illustrated embodiment, the blank 3 has two bottom flaps 49, 51 foldably connected to opposite ends of the bottom panel 23. The blank 3 has a first front side panel 55 and a second front side panel 57 foldably connected to respective opposite ends of the front panel 25. The blank 3 has a first back side flap 61 and a second back side flap 63 foldably connected to respective opposite ends of the back panel 31. In the embodiment of FIG. 1, each of the bottom flaps 49, 51 has a respective locking portion 52, 54, but the bottom flaps could be otherwise shaped, arranged and/or configured without departing from the disclosure. In accordance with an alternative embodiment of the present disclosure, different panel and flap arrangements can be used for closing the carton 5.

The first bottom flap 49, the first front side flap 55, and the first back side flap 61 extend along a first marginal area of the blank 3, and are foldably connected at a first longitudinal fold line 71 that extends along the length of the blank. The second bottom flap 51, the second front side flap 57, and the second back side flap 63 extend along a second marginal area of the blank 3, and are foldably connected at a second longitudinal fold line 75 that extends along the length of the blank. The longitudinal fold lines 71, 75 may be, for example, substantially straight, or offset at one or more locations to account for blank thickness or for other factors. The first and second back side flaps 61, 63 include respective cuts 77, 79. The cut 77 in the first back side flap 61 is for receiving the first bottom flap 49 when the blank 3 is formed into the carton 5. The cut 79 in the second back side flap 63 is for receiving the second bottom flap 51 when the blank 3 is formed into the carton 5. The first and second bottom flaps 49, 51 can be otherwise, shaped, arranged, and/or positioned when the carton 5 is formed from the blank without departing from the disclosure.

In the illustrated embodiment, the blank 3 includes a first gusset 81 foldably connected to the second top panel 41 and the first back side flap 61. The first gusset 81 includes a first gusset panel 83 foldably connected to the first back side flap 61 at a portion 45*a* of the lateral fold line 45, and a second gusset panel 85 foldably connected to the first gusset panel at an oblique fold line 87. The second gusset panel 85 is foldably connected to the second top panel 41 at a portion 71*a* of the longitudinal fold line 71. In the illustrated embodiment, the first gusset panel 83 and the second gusset panel 85 are both generally triangular-shaped panels, but the gusset panels could be otherwise shaped, arranged, and positioned without departing from the disclosure.

The blank 3 includes a second gusset 91 foldably connected to the second top panel 41 and the second back side flap 63. The second gusset 91 is similarly shaped as the first gusset 81 and includes a first gusset panel 93 and a second gusset panel 95 foldably connected to the first gusset panel at an oblique fold line 97. The first gusset panel 93 is foldably connected to the second back side flap 63 at a portion 45*b* of the lateral fold line 45 and the second gusset panel 95 is foldably connected to the second top panel 41 at a portion 75*a* of the longitudinal fold line 75. The first gusset 81 and the second gusset 91 could include other panels, features, etc. or could be otherwise shaped, arranged, and/or configured without departing from the disclosure. Furthermore, the fold lines 45, 45*a*, 71, 71*a*, 75, 75*a* could be otherwise shaped, arranged, configured, and/or omitted without departing from the disclosure. Further, the portions 45*a*, 71*a*, 75*a* of the respective fold lines 45, 71, 75 could be offset or out of alignment with the respective fold lines without departing from the disclosure.

In the illustrated embodiment, the first top panel 37 includes a base portion 103 foldably connected to the front panel 25 at the lateral fold line 39. The first top panel 37 includes a first top flap 105 foldably connected to the base portion 103 at a lateral fold line 109 and comprising a marginal portion of the first top panel. The first top panel 37 could be otherwise shaped, arranged, and configured without departing from the disclosure.

The second top panel 41 includes a base portion 113 foldably connected to the first gusset 81, the second gusset 91, and the back panel 31. The second top panel 41 includes a second top flap 115 foldably connected to the base portion 113 at a lateral fold line 117 and comprising a marginal portion of the second top panel. In the illustrated embodiment, the lateral fold line 117 is located on the blank 3 laterally beyond the edge of the edge of the first and second gusset 81, 91. The second top panel 41 could be otherwise shaped, arranged, and configured without departing from the disclosure.

The bank 3 can by formed into the carton 5 and loaded with articles by a suitable packaging system (not shown). The packaging system can comprise different stations, modules, or components, such as a carton forming station, a wrapping station, a pick and place station, a closing or sealing station, or any other suitable station or components. One particularly useful packaging system that can be suitable for assembling, loading, and closing the carton 5 includes suitable components manufactured by Doboy, Inc. of New Richmond, Wis. For example, the packaging system could include a Doboy Model 7520 Carton Former, a Doboy wrapper, a Doboy Model 8800 tri-seal carton closer, and a Doboy pick and place system. The blank 3 can be formed into the carton 5 by other packaging systems without departing from the disclosure.

Figure 3:
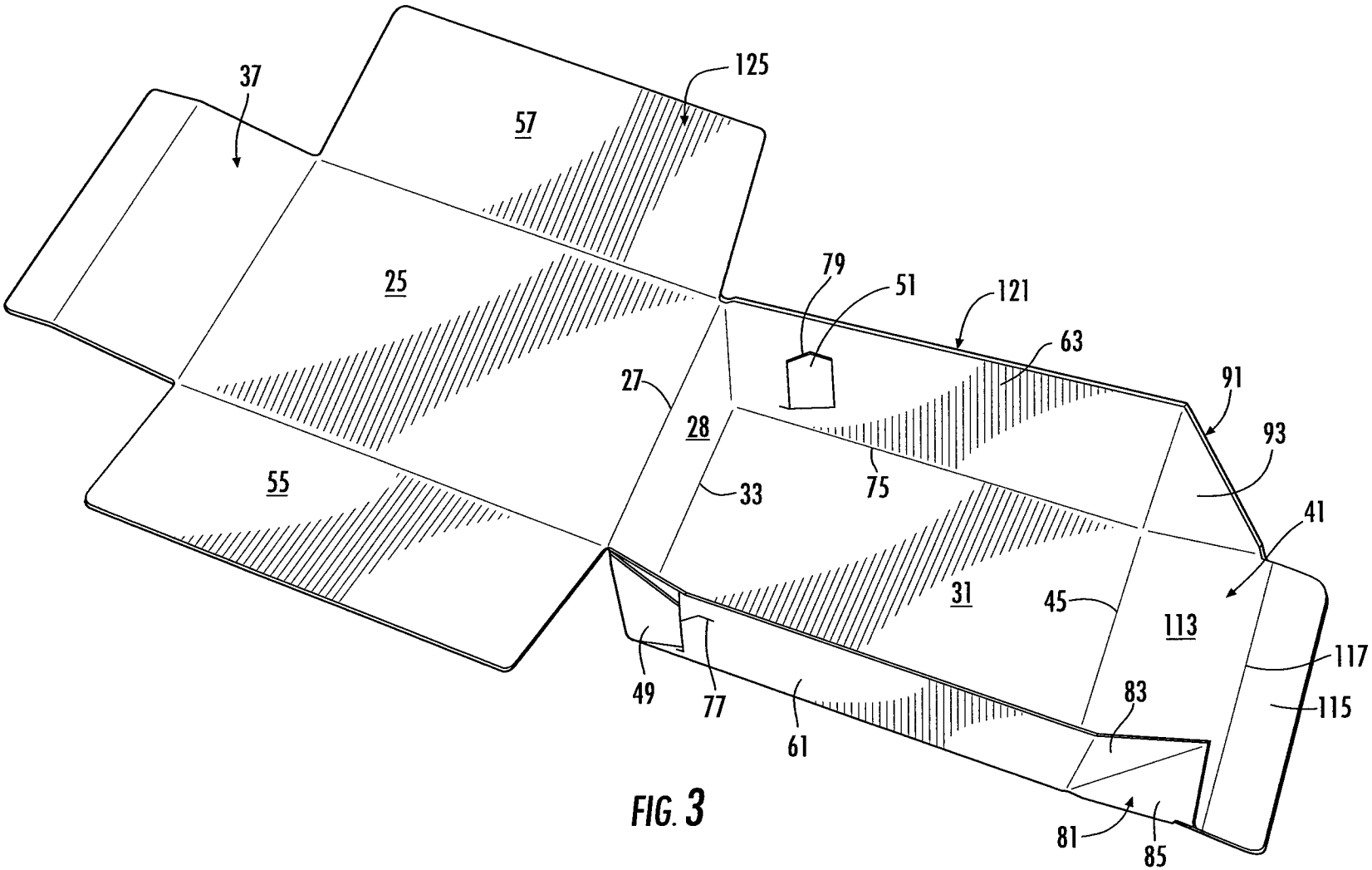
FIGS. 3-8 are various views of the blank of FIG. 1 being formed into the carton.
Figure 4:
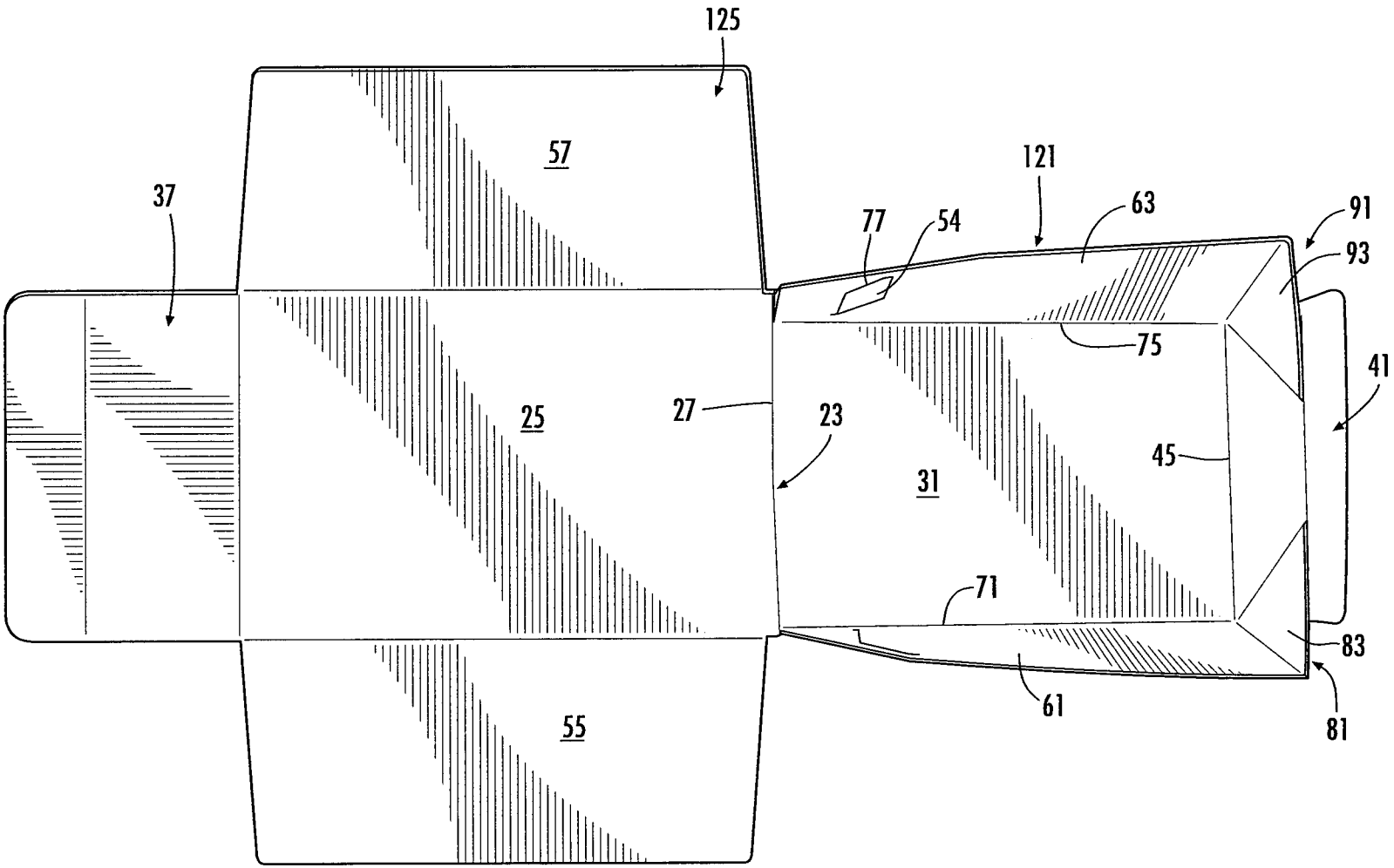
Figure 5:
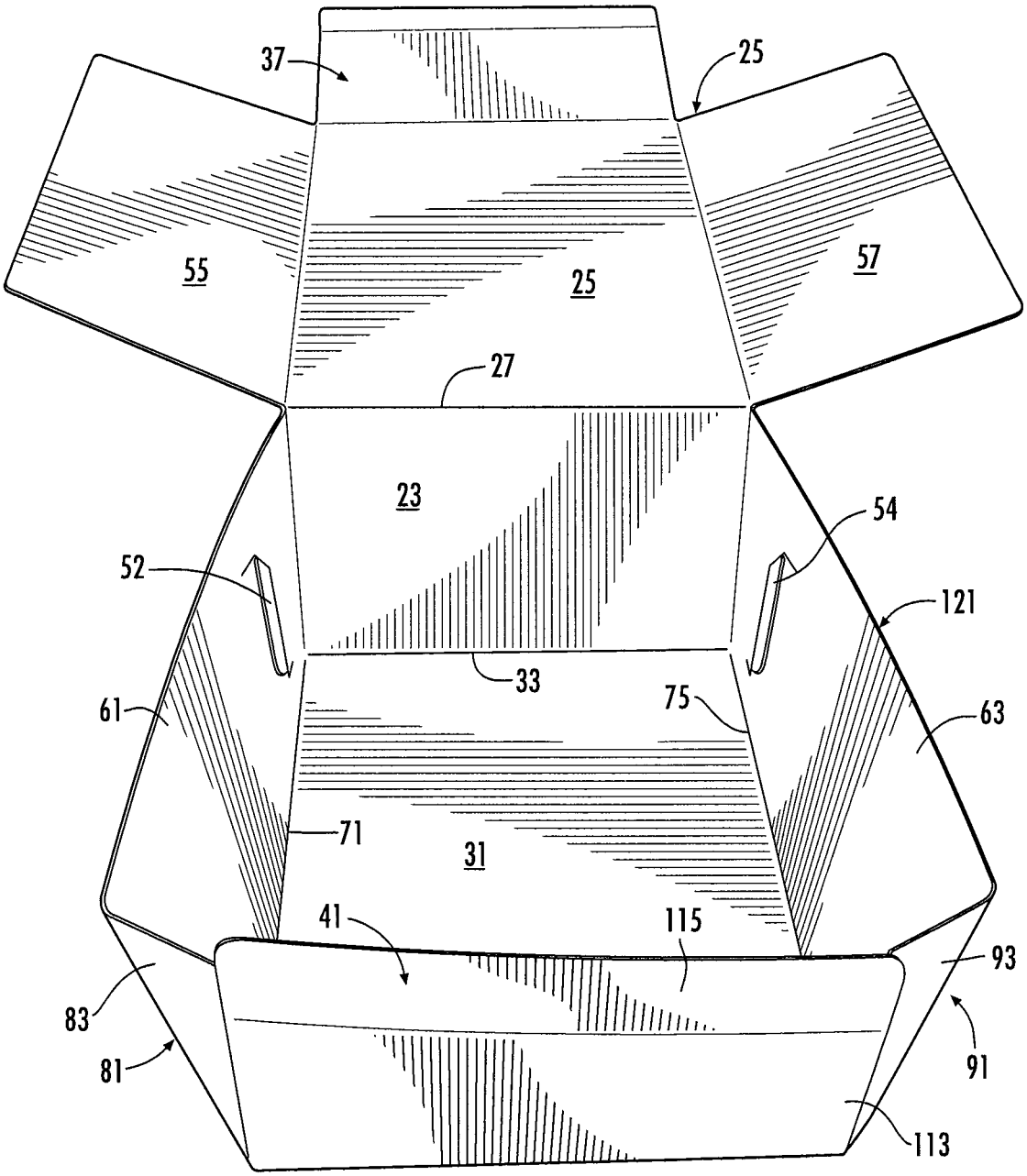

As shown in FIGS. 3-8, and described in the following in accordance with one acceptable example, the carton 5 is formed from the blank 3, as positioned in FIG. 2, by upwardly folding the first and second back side flaps 61, 63 at respective longitudinal fold lines 71, 75 and upwardly folding the bottom panel 23 at lateral fold line 33. When the first and second back side flaps 61, 63 are respectively upwardly folded, each of the first gusset panels 83, 93 are folded to extend upward from the oblique fold line 87, 97. The bottom flaps 49, 51 are received in a respective cut 77, 79 so that each locking portion 52, 54 engages an edge of the cut to lock the bottom panel 23 in the upwardly folded position. As shown in FIG. 3, the back panel 31, and the upwardly folded bottom panel 23, first and second back side flaps 61, 63, and first gusset panels 83, 93 form a generally open-ended tray 121. The front panel 25, first and second front side flaps 55, 57, and first top panel 37 form a lid 125 that is foldably connected to the tray 121 at the lateral fold line 27. As shown in FIGS. 4 and 5, each of the second gusset panel 85, 95 are inwardly folded to be in face-to-face contact with the base portion 113 of the second top panel 41. The second top panel 41 can be adhesively secured to the second gusset panels 85, 95 and upwardly folded at lateral fold line 45. The upwardly folding of the second top panel 41 closes the open-ended tray 121 and forces the side flaps 61, 63 to angle outwardly from the longitudinal fold lines 71, 75. The tray 121 and lid 125 could be otherwise shaped, arranged, and/or configured and could be formed by other folding and positioning steps without departing from the disclosure.

The carton 5 is loaded with articles (e.g., food products) in the partially assembled position of FIGS. 3 and 4 wherein the tray 121 comprising the back panel 31 and upwardly folded bottom panel 23, first and second back side flaps 61, 63, first gusset panels 83, 93, and upwardly folded second top panel 41 is loaded with articles. In one example, the tray 121 can be formed by an article forming station of a packaging machine and conveyed to an article loading station wherein articles are placed in the tray by loading the articles through the open top of the tray. Alternatively, articles could be loaded into the tray 121 by other methods.

Figure 6:
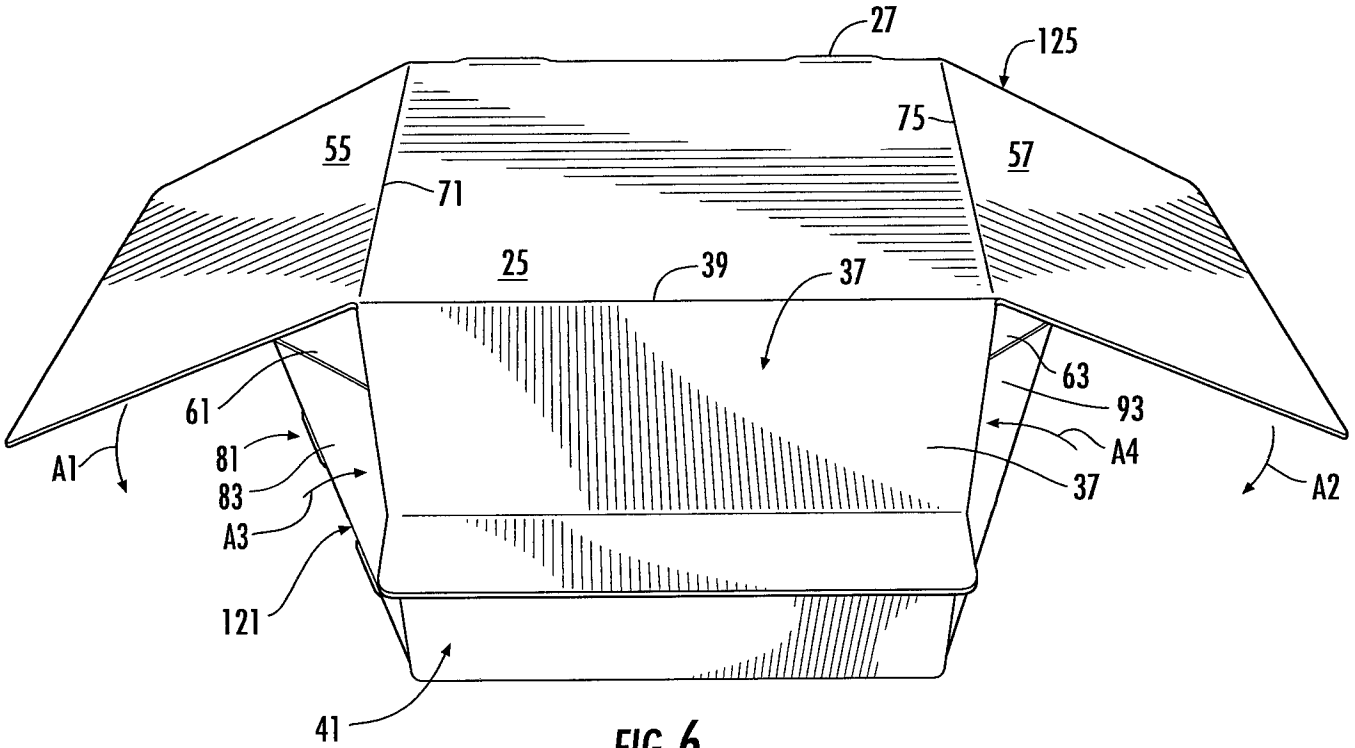
Figure 7:
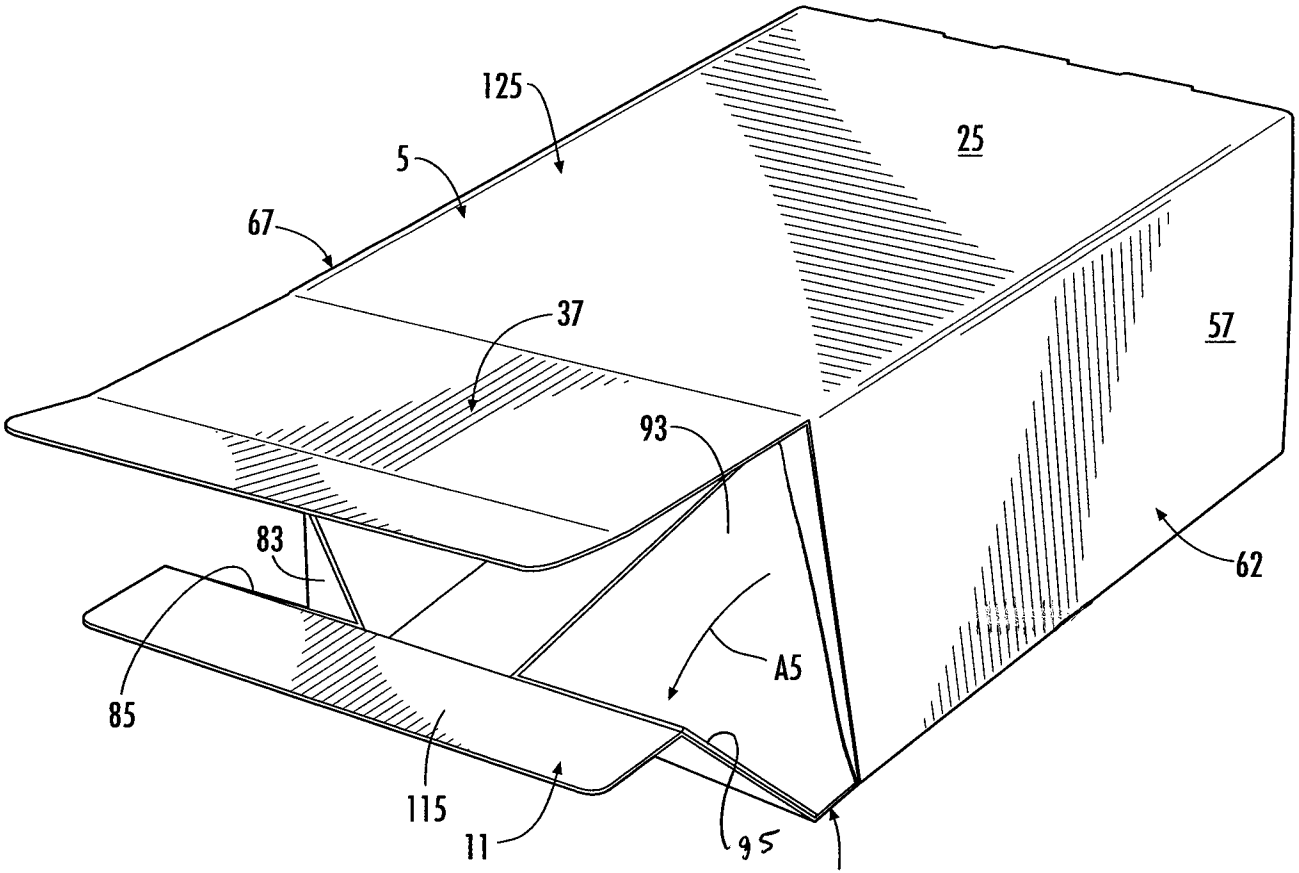
Figure 8:
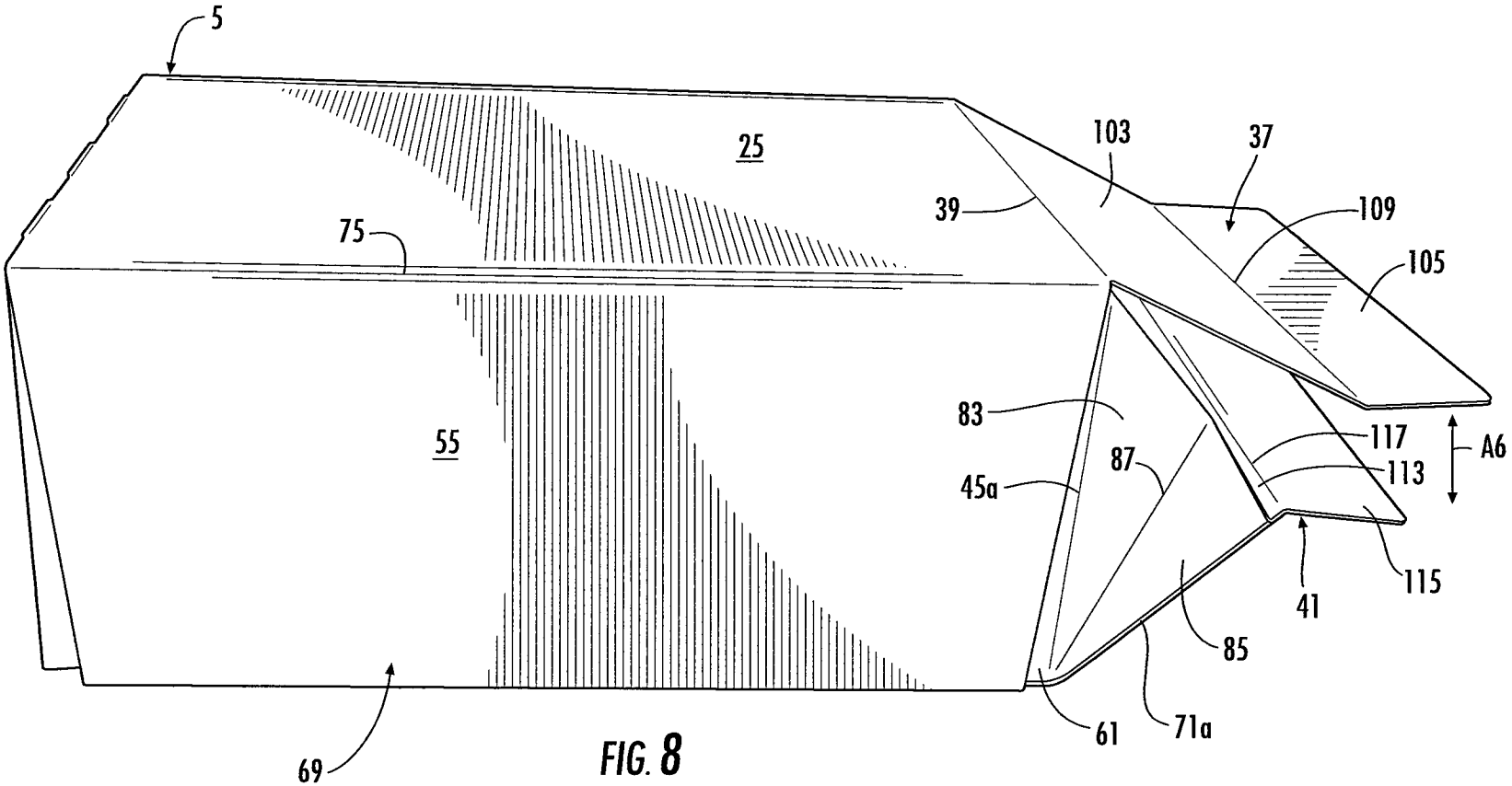

After articles are loaded in the tray 121, the lid 125 is downwardly folded at fold line 27 to close the tray 121 (FIGS. 6 and 7). As shown in FIG. 6, the first and second front side flaps 55, 57 are downwardly folded in the direction of arrows A1, A2 at respective fold lines 71, 75. The first and second front side flaps 55, 57 are brought into face-to-face contact with a respective on of the first and second back side flaps 61, 63 of the tray 121. The folding of the first and second front side flaps 55, 57 of the lid 125 forces the first and second back side flaps 61, 63 in the direction of arrows A3, A4 to be in a generally upright, perpendicular position relative to the bottom panel 31 along the entire length of the first and second back side flaps 61, 63 (FIG. 7). As shown in FIG. 7, when the side first and second front side flaps 55, 57 of the lid 125 are folded down to force the first and second back side flaps 61, 63 of the tray 121 inward, the gussets 81, 91 are expanded in the direction of arrow A5 (FIG. 7) causing the second top panel 41 to be lowered. The connection of the base portion 113 of the second top panel 41 to the second gusset panels 85, 95 causes the second top panel to be lowered when the first gusset panels 83, 93 are positioned upright by the inward folding of the first and second front side flaps 55, 57 of the lid 125. As shown in FIG. 8, the portion 45*a*, 45*b* of the fold line 45 connecting the first gusset panels 83, 93 is brought to a substantially upright and perpendicular position relative to the back panel 31 when the lid 125 is closed on the tray 121. The first and second front side flaps 55, 57 of the lid 125 can be secured to a respective one of the first and second back side flaps 61, 63 of the tray 121 by adhesive such as glue to form respective side panels 67, 69 of the assembled carton 5. Alternatively, the first and second front side flaps 55, 57, or other portions of the lid 125 can be secured to the tray 121 in another manner (e.g., interlocking flaps, etc.).

As shown is FIG. 8, the tray 121 loaded with articles and the lid 125 covering the tray can be attached by moving the two top flaps 105, 115 of the first and second top panels 37, 41 together in the direction of arrow A6. When the two top flaps 105, 115 are secured together, the base portion 103 of the first top flap 37 is inwardly folded relative to the front panel so as to abut a free edge of the first gusset panels 83, 83 of the first and second gussets 81, 91. The base portion 113 of the second top flap 41 is inwardly folded relative to the back panel so that the top panels 37, 41 converge at the top flaps 105, 115. As shown in FIG. 9, the two flaps 105, 115 can be adhesively secured to close the carton 5.

As shown in FIGS. 9 and 10, the gable top 8 of the carton with sloping top walls 11, 13 comprises the first and second top panels 37, 41 and the first and second gussets 81, 91. In the illustrated embodiment, the base portions 103, 113 of the first and second top panels 37, 41 are angled inward from a respective top edge of the front panel 25 and the back panel 31. The first and second top flaps 105, 115 are positioned to be in a generally parallel, planar relationship with the front and back panels 25, 31. The second gusset panels 83, 93 are inwardly folded at a portion 45*a*, 45*b* of the lateral fold line 45 to form a respective closed side of the gable top 8. In the illustrated embodiment, the gable top 8 could be otherwise configured without departing from the disclosure.

The carton 5 could include various handle features for carrying the carton and could include various dispenser features for opening the carton. Further the carton 5 could include other panel/flap closing configurations without departing from the disclosure.

Figure 11:
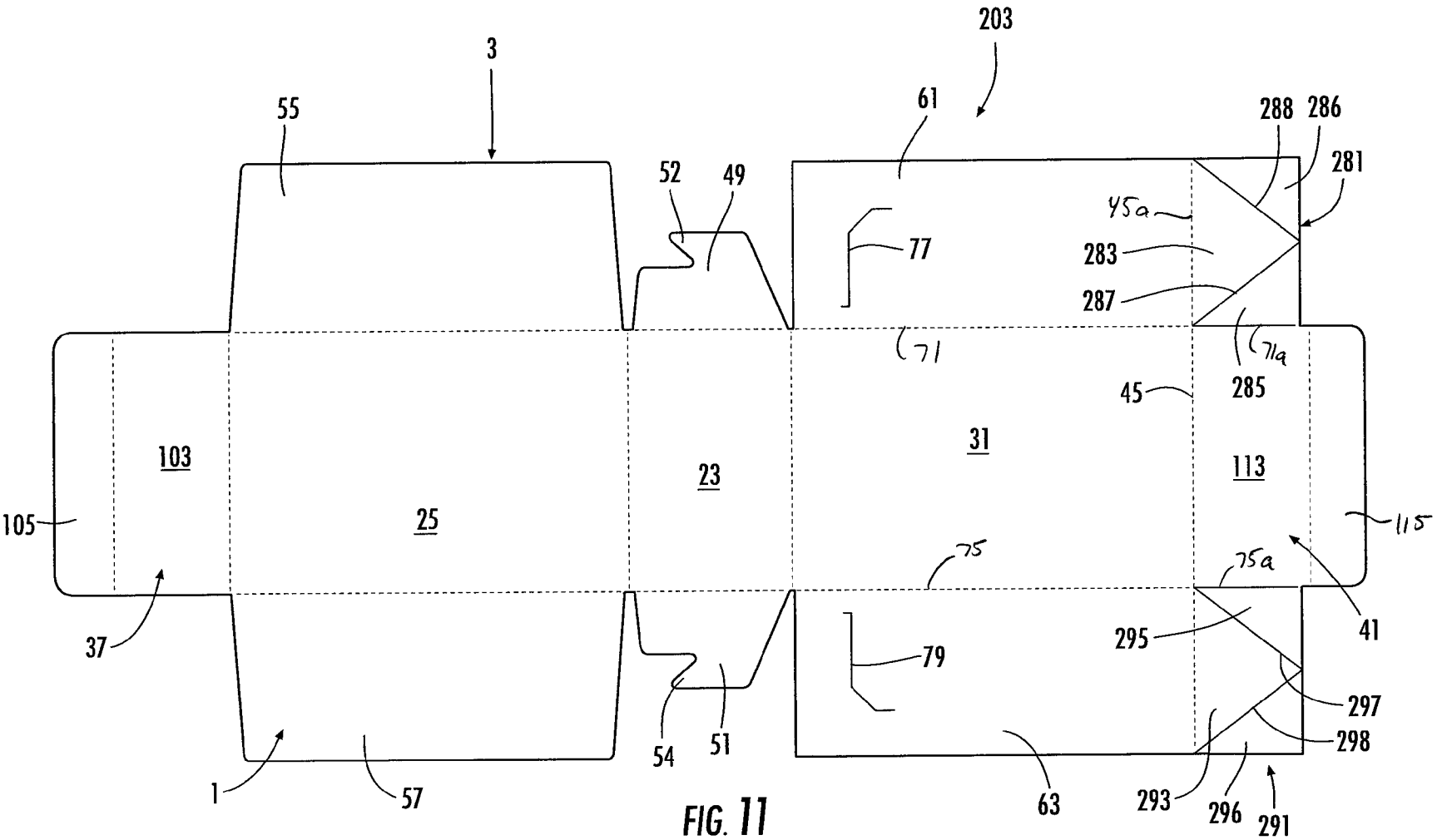
FIG. 11 is a plan view of an exterior surface of a blank for forming a carton of a second embodiment of the disclosure.
Figure 11A:
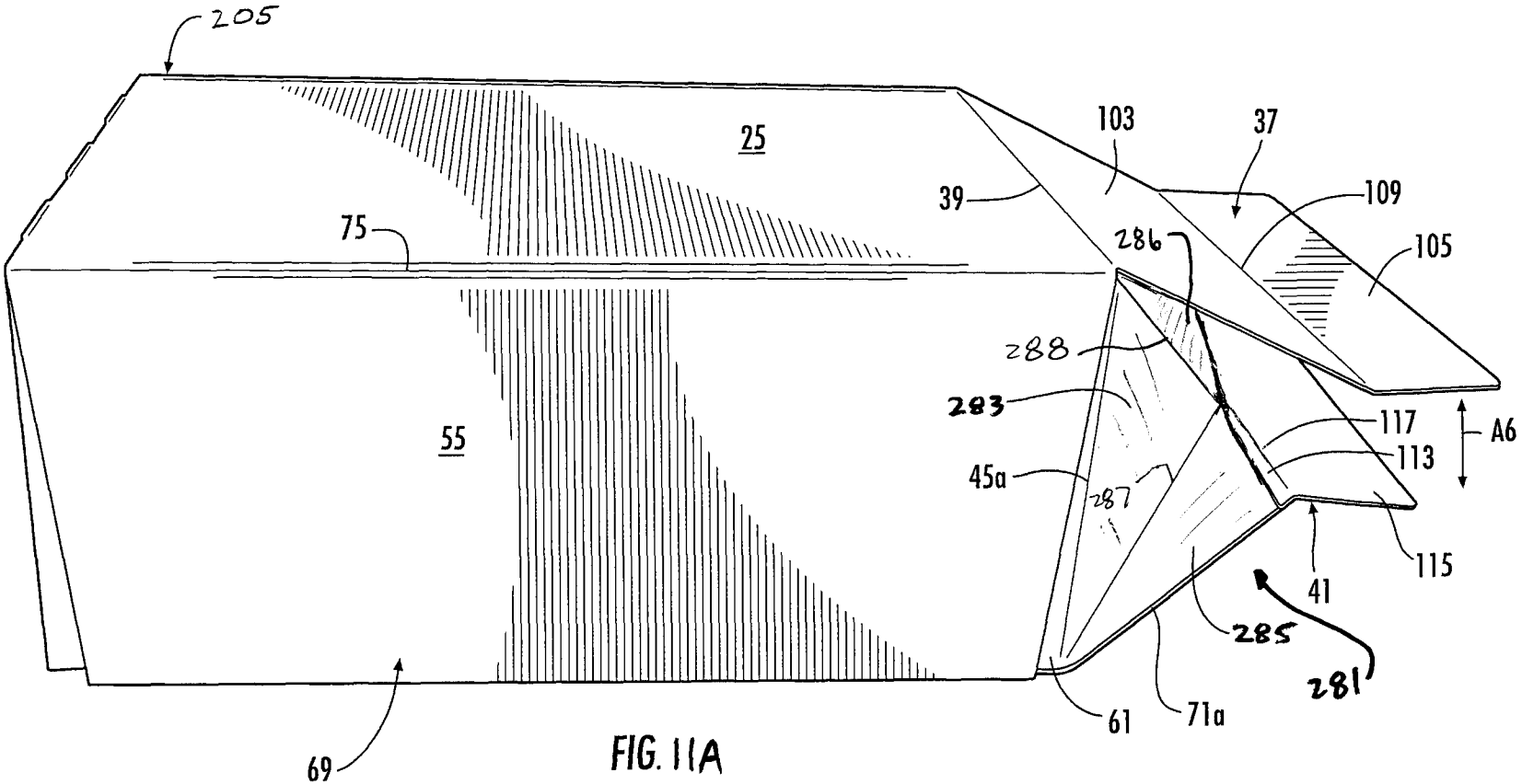
FIGS. 11A and 11B are side perspective views of the carton of the second embodiment.
Figure 11B:
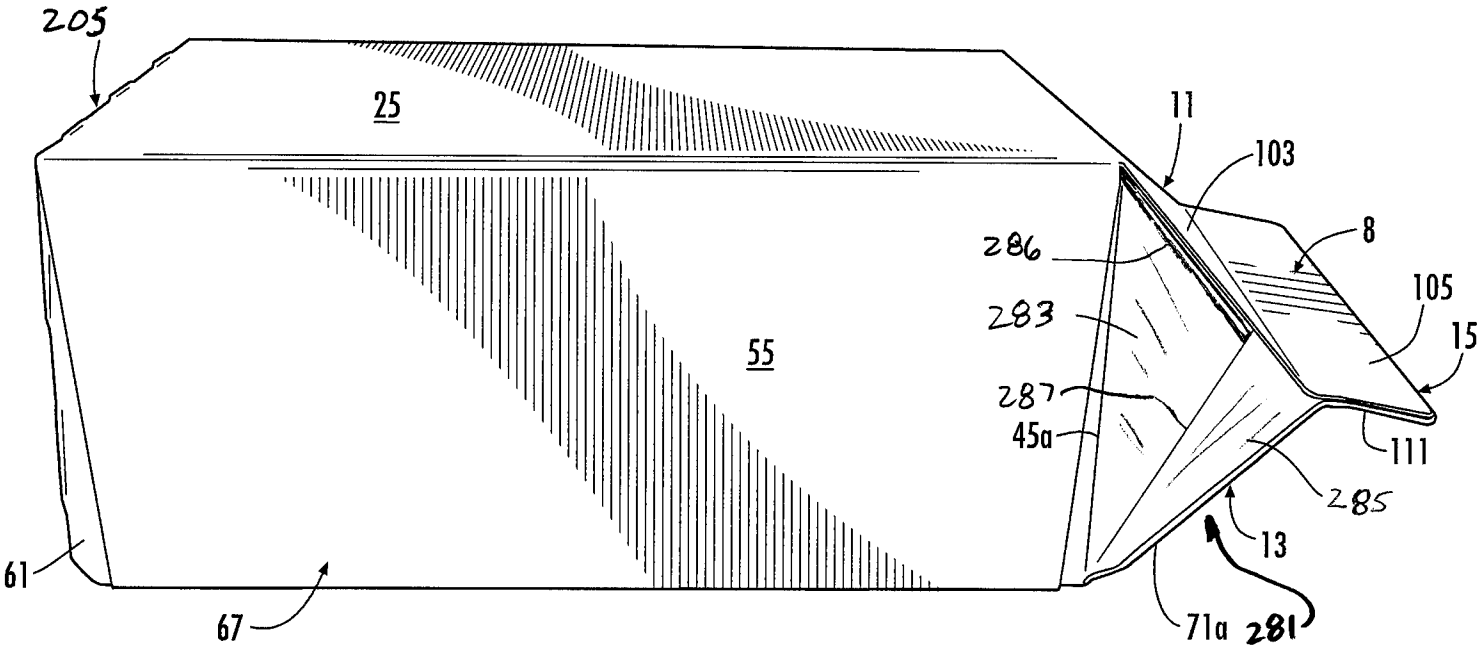

FIG. 11 shows a second embodiment of a blank 203 that is similar to the blank 3 of the first embodiment. Accordingly, similar or identical features of the embodiments are provided with like or similar reference numbers. The blank 203 includes first and second gussets 281, 291 that are alternatively shaped. The first gusset 281 includes three gusset panels 283, 285, 286 and the second gusset 291 includes three gusset panels 293, 295, 296. Each of the third gusset panels 286, 296 is foldably connected to a respective first gusset panel 283, 293 at a respective oblique fold line 288, 298. As shown in FIGS. 11A and 11*b*, when the carton 205 is assembled from the blank 203, the base portion 103 of the first top panel 37 is adhesively attached to the third gusset panels 286, 296 of each of the gussets 281, 291. Each side of the gable top of the carton 205 formed from the blank 203 comprises the middle gusset panel 283, 293 of a respective gusset 281, 291 that extends between a respective third gusset panel 286, 296 that is adhesively connected to the base portion 103 of the first top panel 37 and a respective first gusset panel 285, 296 that is adhesively connected to the base portion 113 of the second top panel 41. Alternatively, the third gusset panels 286, 296 could be otherwise positioned. The blank 203 could be otherwise shaped, arranged, and/or configured.

Figure 12:
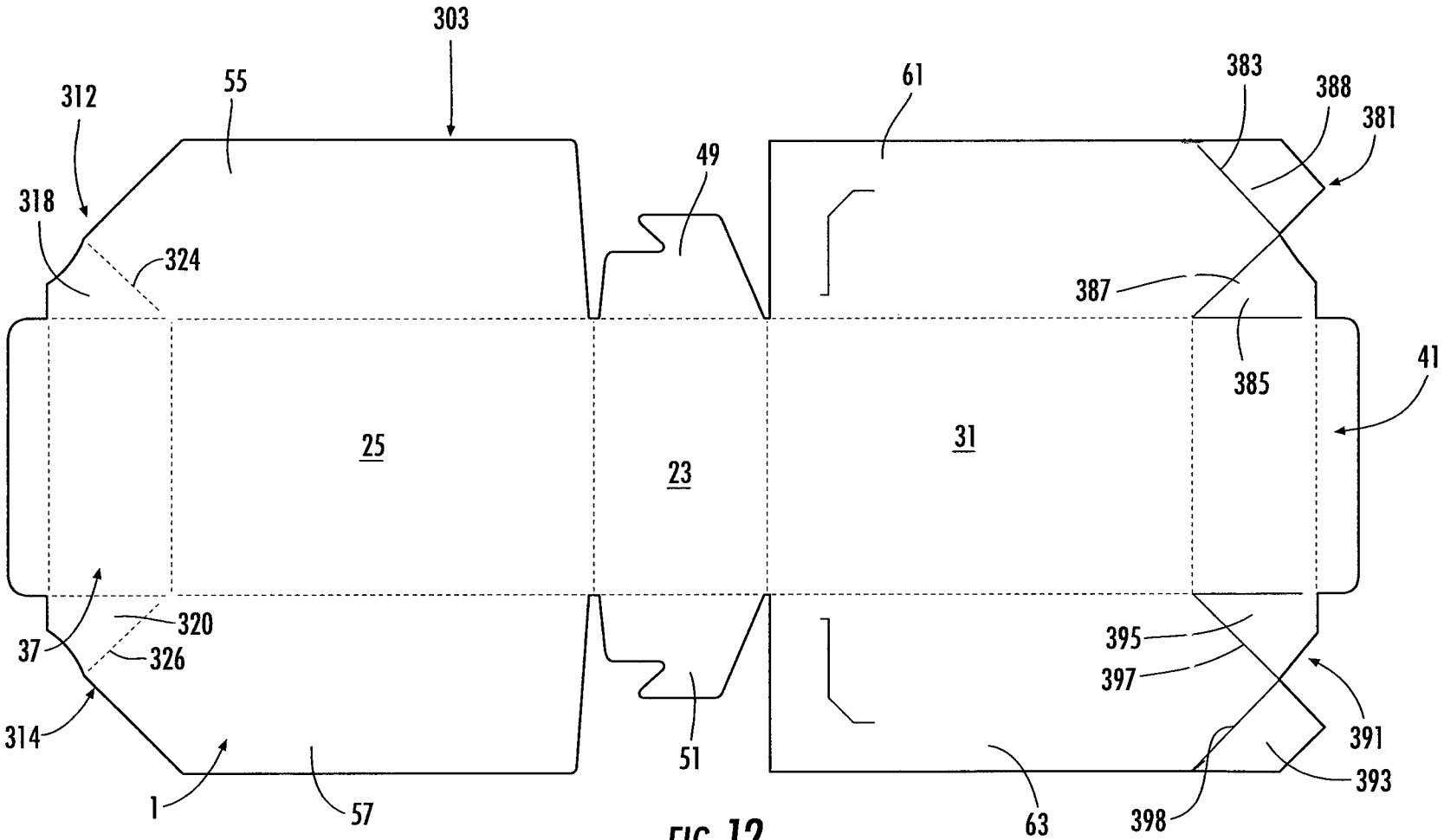
FIG. 12 is a plan view of an exterior surface of a blank for forming a carton of a third embodiment of the disclosure.
Figure 14:
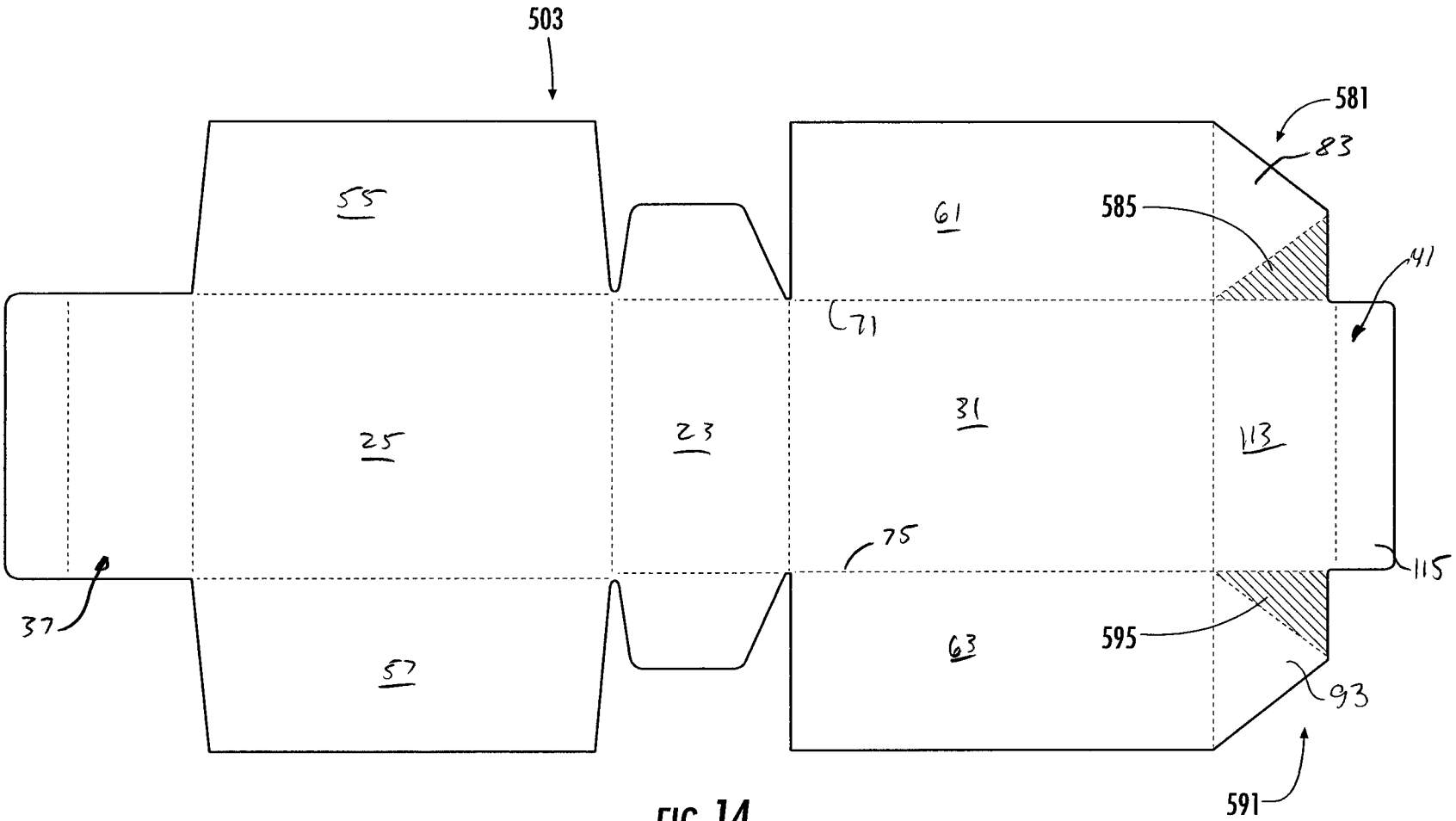
FIG. 14 is a plan a plan view of an exterior surface of a blank for forming a carton of a fifth embodiment of the disclosure.

FIG. 12 shows a third embodiment of a blank 303 that is similar to the previous embodiments. Accordingly, similar or identical features of the embodiments are provided with like or similar reference numbers. The blank 303 includes first and second gussets 381, 391 foldably connecting the first and second back side flaps 61, 63 to the second top panel 41. The first and second gussets 281, 291 include respective first gusset panels 383, 393 and respective second gusset panels 385, 395. In the embodiment of FIG. 14, the second gusset panels 385, 395 are respectively foldably connected to one of the first and second back side flaps 61, 63 at an oblique fold line 387, 397. The first gusset panels 383, 393 are respectively foldably connected to one of the first and second back side flaps 61, 63 at an oblique fold line 388, 398. In the illustrated embodiment, the oblique fold lines 387, 388, 397, 398 of each gusset 381, 391 intersect at a junction of the gusset panels to form a generally V-shaped fold line connecting the gusset panels to a respective first and second back side flap 61, 63.

In the embodiment of FIG. 12, the blank 303 includes a third gusset 312 and a fourth gusset 314 foldably connected to the first top panel 37 and a respective first and second front side flap 55, 57. In one embodiment, each of the third and fourth gussets 312, 314 comprises a single gusset panel 318, 320 foldably connected to a respective one of the first and second front side flap 55, 57 at an oblique fold line 324, 326. The third gusset 312 and/or fourth gusset 314 could be otherwise shaped, arranged, configured, and/or omitted without departing from the disclosure. The blank 303 could be otherwise shaped, arranged, and/or configured.

Figure 13:
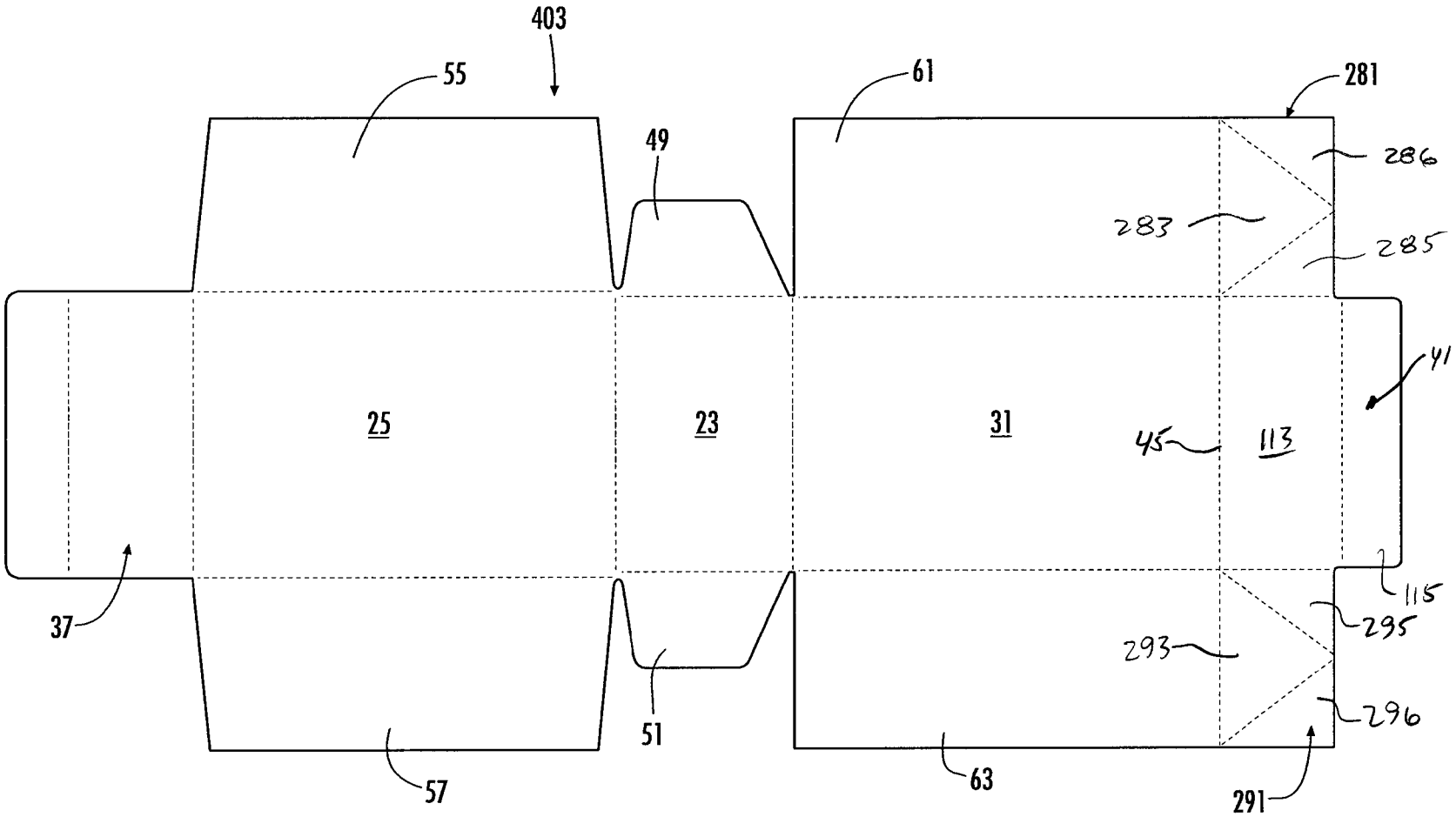
FIG. 13 is a plan view of an exterior surface of a blank for forming a carton of a fourth embodiment of the disclosure.

FIG. 13 shows a fourth embodiment of a blank 403 that is similar to the previous embodiments. Accordingly, similar or identical features of the embodiment are provided with like or similar reference numbers. The blank 403 is similar to the blank 203 of the second embodiment and includes first and second gussets 281, 291. The blank 403 includes bottom flaps 49, 51 attached to the bottom panel 23 that are free from the male locking connectors 52, 54 of the previous embodiments. Further, the first and second back side flaps 61, 63 are free from the cuts 77, 79. When the blank 403 is formed into the carton, the bottom flaps 49, 51 can be respectively adhesively secured to the first and second back side flaps 61, 63 or the first and second front side flaps 55, 57. The blank 403 could be otherwise shaped, arranged, and/or configured.

Figure 16:
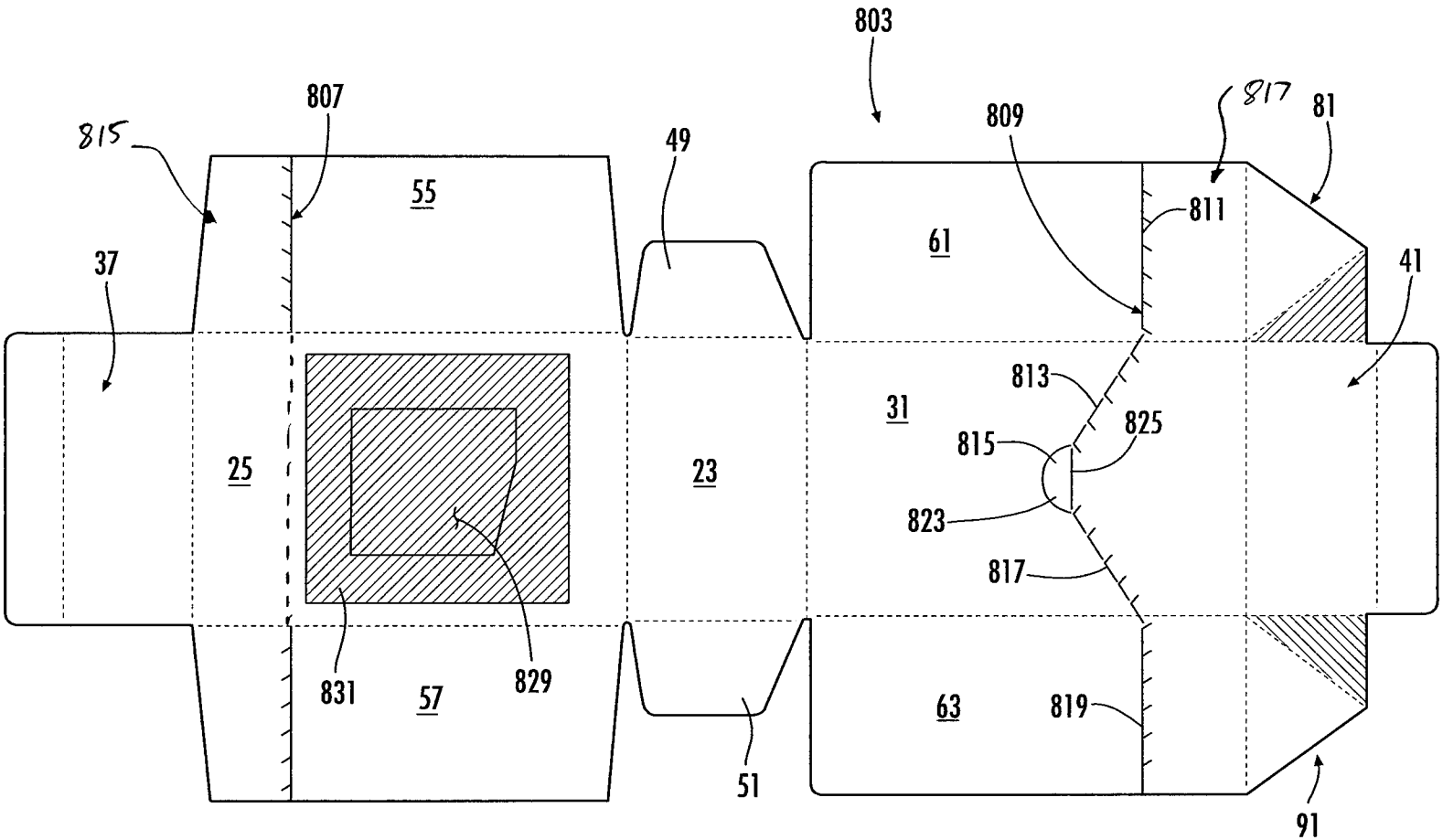
FIG. 16 is a plan view of an exterior surface of a blank for forming a carton of a seventh embodiment of the disclosure Corresponding parts are designated by corresponding reference numbers throughout the drawings.

FIG. 14 shows a fifth embodiment of a blank 503 that is similar to the previous embodiments. Accordingly, similar or identical features of the embodiment are provided with like or similar reference numbers. The blank 503 includes gussets 581, 591 similar to the gussets 81, 91 of the first embodiment. In the embodiment of FIG. 16, glue is applied to the first gusset panels 585, 595 to secure the first gusset panels to the base portion 113 of the second top panel 41 when the carton 5 is formed. The blank 503 could have other features and could be otherwise shaped, arranged, and/or configured without departing from the disclosure.

Figure 15:
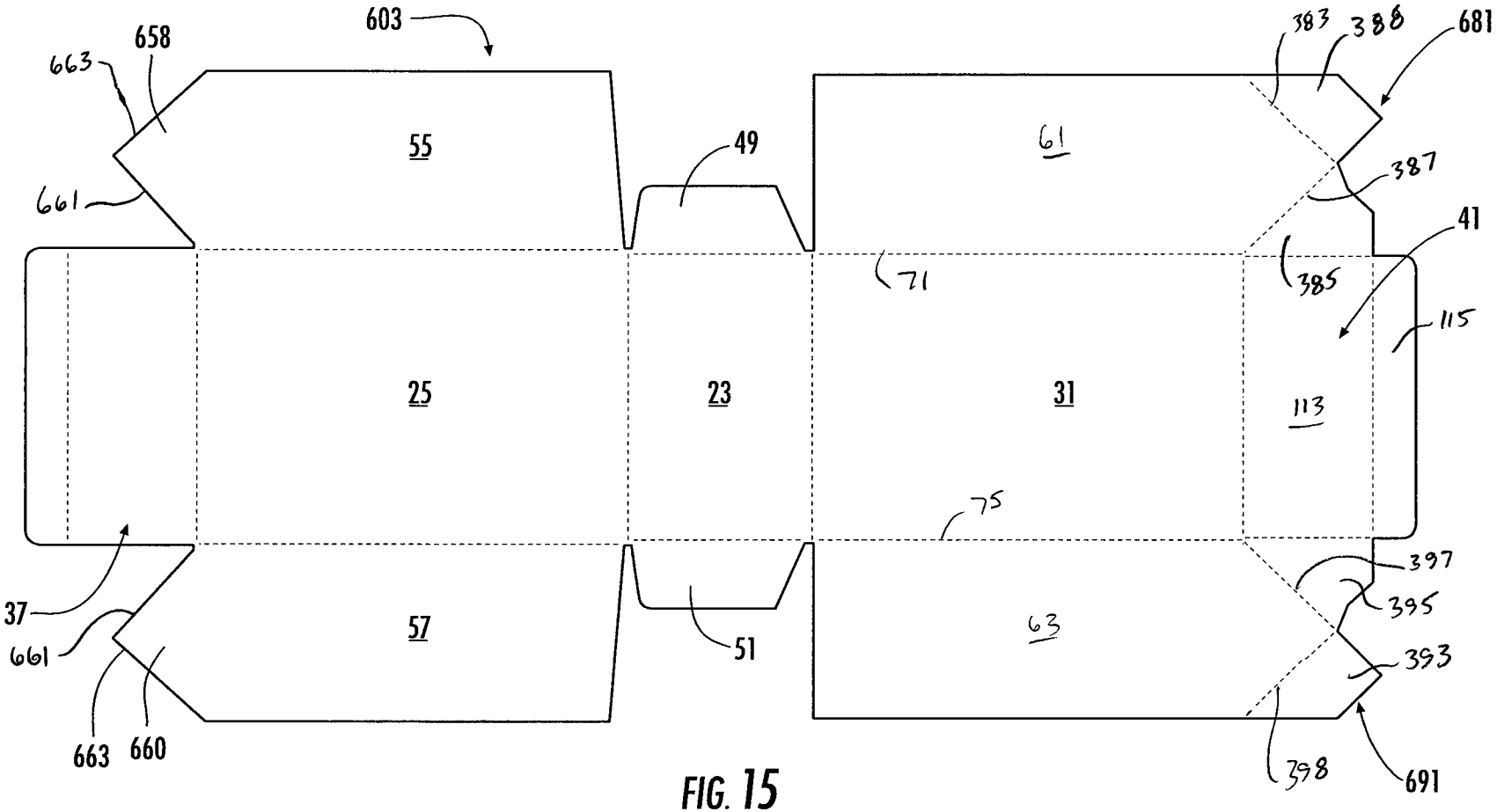
FIG. 15 is a plan view of an exterior surface of a blank for forming a carton of a sixth embodiment of the disclosure.

FIG. 15 shows a sixth embodiment of a blank 603 that is similar to the previous embodiments. Accordingly, similar or identical features of the embodiment are provided with like or similar reference numbers. The blank 603 includes gussets 681, 691 similar to the gussets 381, 391 of the third embodiment. The blank 603 does not include third and fourth gussets connecting the first top panel 37 to the first and second front side flaps 55, 57. Rather, each of the first and second front side flaps 55, 57 have flap portions 658, 660 with oblique edges 661, 663 that form a pointed end. The blank 603 could have other features and could be otherwise shaped, arranged, and/or configured without departing from the disclosure.

FIG. 16 shows an seventh embodiment of a blank 803 that is similar to the previous embodiments. Accordingly, similar or identical features of the embodiment are provided with like or similar reference numbers. The blank 803 is similar to the blank 503 of the fifth embodiment. The blank 803 includes dispensing features in the form of a first tear line 807 extending laterally across the side flap 55, the front panel 25, and the side flap 57, and a second tear line 809 extending across the side flap 61, the back panel 31, and the side flap 63. The first and second tear lines 807, 809 form a dispenser panel in the carton assembled from the blank 803. The dispenser panel has a first portion 815 in the lid (e.g., lid 125) comprising front panel 25 and a second portion 817 in the tray (e.g., tray 121) comprising the back panel 31. The dispenser is separated from the carton to allow articles to be removed from the carton. In the illustrated embodiment, the dispenser panel comprises a top portion of the carton, but the dispenser panel could be otherwise shaped, arranged, and/or configured.

In the illustrated embodiment, the tear line 809 includes a first lateral portion 811 in the first back side flap 61, a first oblique portion 813 in the back panel 31, a curved portion 815 in the back panel, a second oblique portion 817 in the back panel, and a second lateral portion 819 in the second back side flap 63. The curved portion 815 of the tear line 809 forms a finger flap 823 that is foldably connected to the back panel 31 at a lateral fold line 825. The finger flap 823 could be otherwise shaped, arranged, and or positioned (e.g., in the front panel 25) without departing from the disclosure. Further, the dispenser panel and tear lines 807, 809 could be otherwise shaped, arranged, and positioned, or could be omitted without departing from the disclosure. For example, the dispenser panel could comprise only a portion of one or more of the panels (e.g. front panel 25, back panel 31).

In the embodiment of FIG. 16, the front panel 25 includes an opening 829. The opening 829 can be covered by a transparent film 831 to allow viewing of articles held within the carton. The transparent film 831 can be any suitable material and can be adhesively attached to the front panel 25. Alternatively, the opening 829 could be otherwise shaped, arranged, and/or positioned (e.g., in the back panel 31) without departing from the disclosure.

The blanks 203, 303, 403, 503, 603, and 803 of the second through seventh embodiments can be formed into a carton similar to the carton 5 of the first embodiment and having a gable top 8 similar to the carton of the first embodiment. Further, any of the blanks 2, 203, 303, 403, 503, 603, or 803 can be formed into a carton by other forming or positioning steps that are similar or different that the carton forming steps disclosed herein.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprises:

a plurality of panels that extends at least partially around the interior of the carton, the panels comprise
a front panel,
a first top panel foldably connected to the front panel,
a bottom panel foldably connected to the front panel,
a back panel foldably connected to the bottom panel, and
a second top panel foldably connected to the back panel, wherein one of the front and back panels at least partially forms a lid and the other of the front and back panels at least partially forms a tray;

at least one side flap foldably connected to at least one of the front and back panels; and at least one gusset foldably connected to the at least one side flap and one of the first and the second top panels, wherein the at least one gusset comprises a first gusset panel foldably connected to the at least one side flap and a second gusset panel foldably connected to one of the first top panel and the second top panel, and the second gusset panel is at least partially in face-to-face contact with at least a portion of an interior surface of at least one of the first top panel and the second top panel;

wherein at least a portion of each of the first and second top panels angles upwardly and inwardly from a respective front panel and back panel and the first top panel is at least partially in face-to-face contact with the second top panel to form a top of the carton.

2. The carton of claim 1 wherein the at least one side flap comprises a first back side flap foldably connected to the back panel and a second back side flap foldably connected to the back panel, the bottom panel, the back panel, the first back side flap, the second back side flap, the at least one gusset, and the second top panel at least partially form the tray.

3. The carton of claim 2 further comprising a first bottom flap foldably connected to the bottom panel and a second bottom flap foldably connected to the bottom panel.

4. The carton of claim 2 further comprising a first front side flap foldably connected to the front panel, and a second front side flap foldably connected to the front panel, the first front side flap, the second front side flap, the front panel, and the first top panel at least partially form the lid.

5. The carton of claim 4 wherein the at least one gusset comprises a first gusset and a second gusset, the first gusset panel of each of the first gusset and the second gusset is foldably connected to a respective one of the first back side flap and the second back side flap, the second gusset panel of the first gusset is foldably connected to the first gusset panel of the first gusset, and the second gusset panel of the second gusset is foldably connected to the first gusset panel of the second gusset.

6. The carton of claim 5 wherein each first gusset panel is connected to a respective second gusset panel at an oblique fold line.

7. The carton of claim 6 wherein the first gusset is connected to the second top panel at a first longitudinal fold line and the second gusset is connected to the second top panel at a second longitudinal fold line, and the second gusset panel of each of the first and second gussets is in face-to-face contact with at least a portion of the interior surface of the second top panel.

8. The carton of claim 5 wherein the first top panel comprises a first base portion foldably connected to the front panel and a first top flap at a respective marginal portion of the first top panel, and the second top panel comprises a second base portion foldably connected to the back panel and a second top flap at a respective marginal portion of the second top panel.

9. The carton of claim 8 wherein the first and second base portions slope inwardly from a respective front and back panel, and the first and second top flaps are at least partially in face-to-face contact and are generally parallel to the front and back panels.

10. The carton of claim 9 wherein the first top flap is adhered to the second top flap.

11. The carton of claim 8 wherein the second gusset panels of each of the first and second gussets are in face-to-face contact with the second base portion.

12. The carton of claim 11 wherein each of the second gusset panels is adhered to the second base portion.

13. The carton of claim 8 wherein each of the first gusset and the second gusset comprises a third gusset panel foldably connected to the first gusset panel, wherein each of the third gusset panels is adhered to the first base portion.

14. The carton of claim 13 wherein for each of the first and second gussets, the first gusset panel is foldably connected to the second and third gusset panels at a respective first and second oblique fold line.

15. The carton of claim 13 wherein the first back side flap is connected to the back panel at a first longitudinal fold line, the second back side flap is connected to the back panel at a second longitudinal fold line, and each first gusset panel is foldably connected to a respective one of the first and second back side flaps at a respective lateral fold line.

16. The carton of claim 2 wherein the at least one gusset comprises a first gusset and a second gusset, and each first gusset panel is foldably connected to a respective one of the first and second back side flaps at a first oblique fold line and each second gusset panel is foldably connected to a respective one of the first and second back side flaps at a second oblique fold line.

17. The carton of claim 16, wherein the first and second oblique fold lines are arranged to form an inverted V shape with the second oblique fold line extending from a transverse fold line connecting the second top panel to the back panel and the first and second gusset panels meet at the apex of the inverted V shape.

18. The carton of claim 17 wherein the at least one side flap further comprises a first front side flap foldably connected to the front panel and a second front side flap foldably connected to the front panel, and each of the first and second front side flaps comprises two oblique edges that form a pointed end proximate to the first top panel.

19. The carton of claim 16 wherein the at least one gusset further comprises a third gusset and a fourth gusset, each of the third gusset and the fourth gusset comprises a gusset panel connected to the first top panel.

20. The carton of claim 19 wherein the at least one side flap further comprises a first front side flap foldably connected to the front panel and a second front side flap foldably connected to the front panel, and the gusset panel of each of the third gusset and the fourth gusset is foldably connected to a respective one of the first and second front side flaps at a respective oblique fold line.

21. The carton of claim 1, further comprising a dispenser that comprises at least one tear line extending at least partially across at least one of the front and back panels.

22. The carton of claim 21, the at least one tear line comprises a first tear line extending in the back panel and a second tear line extending in the front panel, at least one of the first and second tear lines extending across at least a portion of the at least one side flap.

23. The carton of claim 22, the second tear line extending generally laterally across at least a portion of the front panel.

24. The carton of claim 22, the first tear line comprises a first oblique portion and a second oblique portion, the first and second oblique portions converging on a finger flap in the back panel.

25. The carton of claim 1, the front panel defining an opening, wherein a generally transparent film is applied to the front panel to at least partially cover the opening.

26. A carton for containing a plurality of articles, the carton comprises:

a plurality of panels that extends at least partially around the interior of the carton, the plurality of panels comprises a front panel, a first top panel foldably connected to the front panel, a bottom panel foldably connected to the front panel, a back panel foldably connected to the bottom panel, and a second top panel foldably connected to the back panel, wherein one of the front and back panels at least partially forms a lid and the other of the front and back panels at least partially forms a tray;

at least one side flap foldably connected to at least one of the front and back panels, wherein the at least one side flap comprises a first back side flap foldably connected to the back panel and a second back side flap foldably connected to the back panel;

at least one gusset foldably connected to the at least one side flap and one of the first and the second top panels, wherein the bottom panel, the back panel, the first back side flap, the second back side flap, the at least one gusset, and the second top panel at least partially form the tray; and a first bottom flap foldably connected to the bottom panel and a second bottom flap foldably connected to the bottom panel, wherein each of the first and second bottom flaps comprise a locking portion and the first and second back side flaps each comprise a respective cut that receives the locking portion of the respective first and second bottom flap;

wherein at least a portion of each of the first and second top panels angles upwardly and inwardly from a respective front panel and back panel and the first top panel is at least partially in face-to-face contact with the second top panel to form a top of the carton.

27. The carton of claim 26 wherein the first and second bottom flaps are each at least partially in face-to-face contact with an external surface of the respective first and second back side flaps.

28. A blank for forming a carton for holding a plurality of articles, the blank comprises:

a plurality of panels that comprise a front panel, a first top panel foldably connected to the front panel, a bottom panel foldably connected to the front panel, a back panel foldably connected to the bottom panel, and a second top panel foldably connected to the back panel, wherein one of the front and back panels is for forming a lid in the carton formed from the blank and the other of the front and back panels is for forming a tray in the carton formed from the blank;

at least one side flap foldably connected to at least one of the front and back panels along a longitudinal fold line, the at least one side flap comprising a free edge that is generally parallel to the longitudinal fold line; and at least one gusset foldably connected to the at least one side flap and one of the first and the second top panels, wherein at least a portion of each of the first and second top panels is for being positioned to angle inwardly and upwardly from a respective front panel and back panel and the first top panel is for being positioned to be at least partially in face-to-face contact with the second top panel to form a top of the carton formed from the blank.

29. The blank of claim 28 wherein the at least one side flap comprises a first back side flap foldably connected to the back panel and a second back side flap foldably connected to the back panel.

30. The blank of claim 29 further comprising a first bottom flap foldably connected to the bottom panel and a second bottom flap foldably connected to the bottom panel.

31. The blank of claim 29 further comprising a first front side flap foldably connected to the front panel, and a second front side flap foldably connected to the front panel.

32. The blank of claim 31 wherein the at least one gusset comprises a first gusset and a second gusset, each of the first gusset and the second gusset comprises a first gusset panel foldably connected to a respective one of the first back side flap and the second back side flap, and a second gusset panel foldably connected to the first gusset panel and one of the first top panel and the second top panel.

33. The blank of claim 32 wherein each first gusset panel is connected to a respective second gusset panel at an oblique fold line.

34. The blank of claim 33 wherein the first gusset is connected to the second top panel at a first longitudinal fold line and the second gusset is connected to the second top panel at a second longitudinal fold line.

35. The blank of claim 34 wherein the at least one gusset further comprises a third gusset and a fourth gusset, each of the third gusset and the fourth gusset comprises a gusset panel connected to the first top panel.

36. The blank of claim 35 wherein the gusset panel of each of the third gusset and the fourth gusset is foldably connected to a respective one of the first and second front side flaps at a respective oblique fold line.

37. The blank of claim 32 wherein the first top panel comprises a first base portion foldably connected to the front panel and a first top flap at a respective marginal portion of the first top panel, and the second top panel comprises a second base portion foldably connected to the back panel and a second top flap at a respective marginal portion of the second top panel.

38. The blank of claim 32 wherein each first gusset panel is foldably connected to a respective one of the first and second back side flaps at a first oblique fold line and each second gusset panel is foldably connected to a respective one of the first and second back side flaps at a second oblique fold line.

39. The blank of claim 38 wherein the first and second oblique fold lines are arranged to form an inverted V shape with the second oblique fold line extending from a transverse fold line connecting the second top panel to the back panel and the first and second gusset panels meet at the apex of the inverted V shape.

40. The blank of claim 39 wherein each of the first and second front side flaps comprises two oblique edges that form a pointed end proximate to the first top panel.

41. The blank of claim 38 wherein the at least one gusset further comprises a third gusset and a fourth gusset, each of the third gusset and the fourth gusset comprises a gusset panel connected to the first top panel.

42. The blank of claim 41 wherein the gusset panel of each of the third gusset and the fourth gusset is foldably connected to a respective one of the first and second front side flaps at a respective oblique fold line.

43. The blank of claim 32 wherein each of the first gusset and the second gusset comprises a third gusset panel foldably connected to the first gusset panel, wherein each of the third gusset panels is adhered to the first base portion.

44. The blank of claim 43 wherein for each of the first and second gussets, the first gusset panel is foldably connected to the second and third gusset panels at a respective first and second oblique fold line.

45. The blank of claim 43 wherein the first back side flap is connected to the back panel at a first longitudinal fold line, the second back side flap is connected to the back panel at a second longitudinal fold line, and each first gusset panel is foldably connected to a respective one of the first and second back side flaps at a respective lateral fold line.

46. The blank of claim 28, further comprising a dispenser panel at least partially defined by at least one tear line extending at least partially across at least one of the front and back panels.

47. The blank of claim 46 wherein the at least one tear line comprises a first tear line extending in the back panel and a second tear line extending in the front panel, at least one of the first and second tear lines extending across at least a portion of the at least one side flap.

48. The blank of claim 28 wherein the front panel comprises an opening, and the blank comprises a generally transparent film is applied to the front panel to at least partially cover the opening.

49. A blank for forming a carton for holding a plurality of articles, the blank comprises:

a plurality of panels that comprise a front panel, a first top panel foldably connected to the front panel, a bottom panel foldably connected to the front panel, a back panel foldably connected to the bottom panel, and a second top panel foldably connected to the back panel, wherein one of the front and back panels is for forming a lid in the carton formed from the blank and the other of the front and back panels is for forming a tray in the carton formed from the blank;

at least one side flap foldably connected to at least one of the front and back panels, wherein the at least one side flap comprises a first back side flap foldably connected to the back panel and a second back side flap foldably connected to the back panel; and at least one gusset foldably connected to the at least one side flap and one of the first and the second top panels, wherein at least a portion of each of the first and second top panels is for being positioned to angle inwardly and upwardly from a respective front panel and back panel and the first top panel is for being positioned to be at least partially in face-to-face contact with the second top panel to form a top of the carton formed from the blank; and a first bottom flap foldably connected to the bottom panel and a second bottom flap foldably connected to the bottom panel; wherein each of the first and second bottom flaps comprise a locking portion and the first and second back side flaps each comprise a respective cut that receives the locking portion of the respective first and second bottom flap.

* * * * *